US005547197A

United States Patent [19]

Pocklington

[11] Patent Number: 5,547,197

[45] Date of Patent: Aug. 20, 1996

[54] GOLF BALL DIMPLE CONSTRUCTION

[75] Inventor: Terence W. Pocklington, Tupelo, Miss.

[73] Assignee: Hansberger Precision Golf Incorporated, Pontotoc, Miss.

[21] Appl. No.: 413,491

[22] Filed: Mar. 30, 1995

[51] Int. Cl.[6] ..... A63B 37/14

[52] U.S. Cl. ..... 473/384

[58] Field of Search ..... 273/232, 62; 40/327

[56] References Cited

U.S. PATENT DOCUMENTS

| | | | |
|---|---|---|---|
| 878,254 | 2/1908 | Taylor | 273/232 |
| 4,877,252 | 10/1989 | Shaw | 273/232 |
| 4,932,664 | 6/1990 | Pocklington et al. | 273/232 |
| 5,127,655 | 7/1992 | Yamada et al. | 273/232 |
| 5,201,522 | 4/1993 | Pocklington et al. | 273/232 |
| 5,273,287 | 12/1993 | Molitor et al. | 273/232 |

FOREIGN PATENT DOCUMENTS

| | | | |
|---|---|---|---|
| 20778 | 9/1911 | United Kingdom | 273/232 |

*Primary Examiner*—George J. Marlo
*Attorney, Agent, or Firm*—Rockey, Rifkin & Ryther

[57] ABSTRACT

A golf ball construction comprising a core and cover, the ball defining an equator forming a first great circle extending over the cover surface. At least two additional great circles extend over the cover surface and intersect the first great circle, the additional great circles being spaced apart equally with respect to each other whereby the ball surface is divided by the combination of the first great circle and the additional great circles into a plurality of discrete symmetrically arranged surface areas. A separate array of spaced-apart dimples is formed on the cover surface within each of the discrete surface areas, each of the arrays covering substantially completely the cover surface in each discrete surface area. Channels are formed exclusively within each area and extend between adjacent ones of the dimples in each area, a channel extending from each dimple to every other dimple adjacent thereto. None of the channels cross any of the great circles.

7 Claims, 1 Drawing Sheet

GOLF BALL DIMPLE CONSTRUCTION

This invention relates to golf balls and in particular to golf balls having a unique dimple construction formed on the surface. The golf balls are otherwise of conventional design in the sense that specifications of the United States Golf Association are complied with from the standpoint of weight and other parameters such as the outer diameter.

Conventional golf ball dimples may exhibit various geometric configurations. Such variations in dimple geometry, size and depth, as well as variations in patterns over the golf ball surface, have been recognized as affecting golf ball performance.

Various dimple patterns designed to enhance the performance characteristics of golf balls are disclosed, for example, in U.S. Pat. Nos. 4,932,664 and 5,201,522 to Pocklington et al. Pocklington application Ser. No. 08/386,812, filed on Feb. 8, 1995 includes a disclosure of dimples of different shapes wherein a central section is surrounded by a depressed section. This application also discusses the effect that the total effective volume of the depressed dimple sections can have on ball performance.

SUMMARY OF THE INVENTION

The golf ball of this invention is characterized by an array of dimples on the golf ball surface. In accordance with conventional practice, the dimples are preferably circular in shape, however, dimples of other shapes are also contemplated.

Each dimple in the array is interconnected with at least two other dimples by means of channels extending between the dimples. Since the channels as well as the dimples are depressed relative to the ball surface, each contributes to the total effective volume of depressions. More importantly, each effects the ball performance, and this has been recognized as providing a desirable effect.

In accordance with preferred forms of the invention, circular dimples from 0.060 to 0.180 inches in diameter are employed. Dimple depths of 0.007 to 0.013 are utilized.

The channels extending between dimples may vary from 0.010 to 0.080 inches in width, but preferably never exceed the dimple diameter. The depth of the channels may vary between 0.003 and 0.010 inches, and it is also preferred that the channel depth not exceed the dimple depth.

Various conventional dimples patterns, such as those described in the aforementioned Pocklington patents and application, may benefit from the use of channels as herein described. A preferred pattern, especially suited for use with the interconnecting channels, comprises an "octahedral" pattern consisting of eight triangular dimple areas. In this form of the invention, each triangular area consists of 45 dimples with a total of 360 dimples formed on the ball surface.

DETAILED DESCRIPTION OF THE INVENTION

Figure 1:
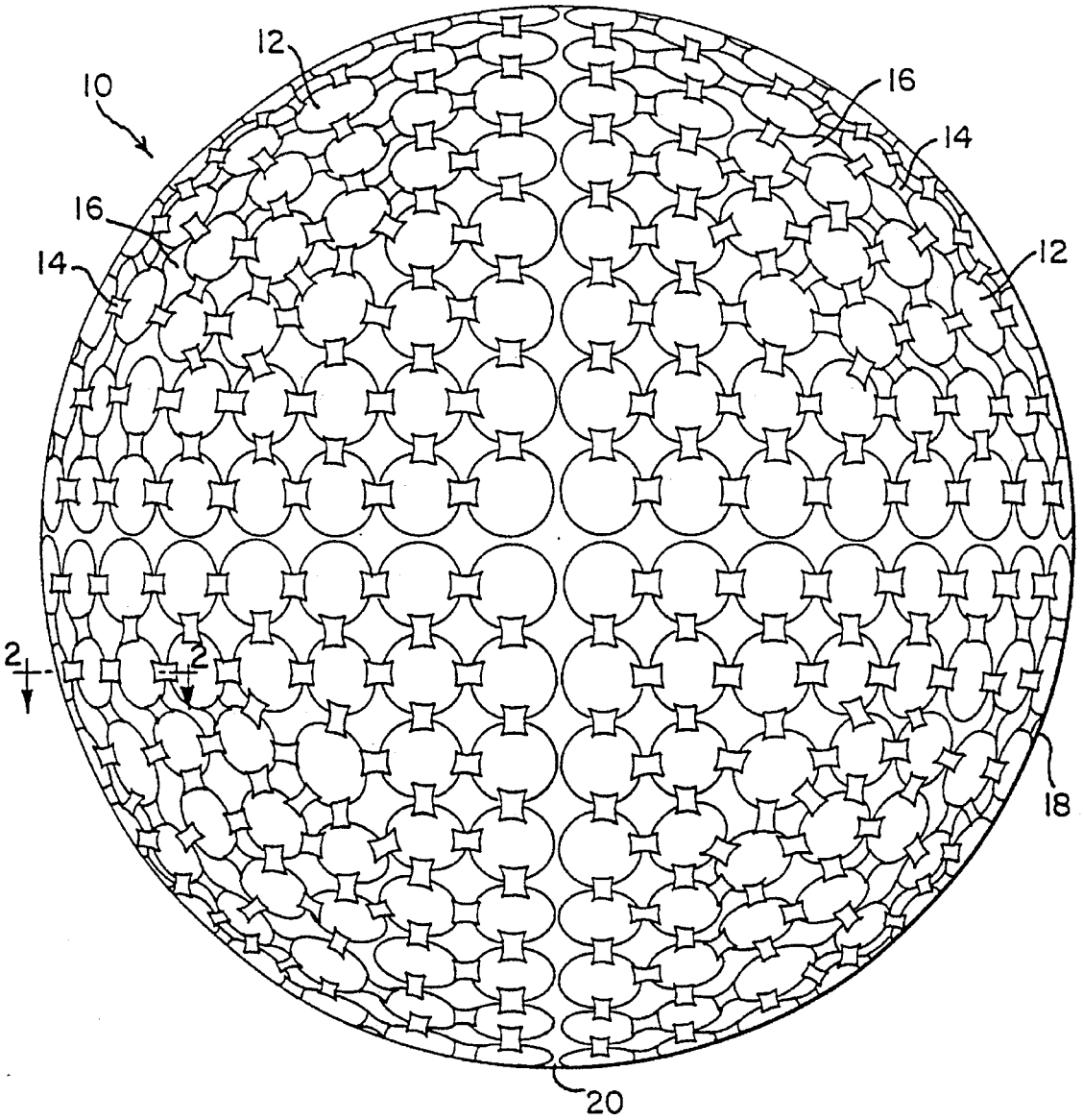
FIG. 1 is an elevational view of a golf ball characterized by the features of this invention; and, FIG. 2 is an enlarged, fragmentary cross-sectional view taken about the line 2—2 of FIG. 1.

The golf ball 10 of FIG. 1 is of conventional design from the standpoint of weight, diameter and other characteristics required for meeting USGA standards. Balls according to this invention may also be conventional from the standpoint of materials and techniques used for manufacturing. Thus, two-piece balls comprising a polybutadiene core with covers from the family of ionomers sold by E. I. du Pont de Nemours & Company under the trademark SURLYN, or ionomers sold under the trademark IOTEK by Exxon Corporation, may be utilized. Three-piece balls including a liquid center, a surrounding thread winding, and a balata cover comprise another example of balls which may be utilized in conjunction with the concepts of this invention.

A plurality of dimples 12 are formed on the golf ball surface. Channels 14 extend between the respective dimples, and land areas 16 are located between the dimples and channels.

In accordance with conventional practice, the golf ball 10 is molded in a process leaving a parting line 18 around the equator of the ball. In the preferred form of the invention, channels 14 are not formed between the dimples on opposite sides of the parting line. To provide symmetry for the ball, it is also preferred that channels 14 are not formed along a first circumferential line 20 extending from "pole to pole" and along a second "pole to pole" line offset 90° from the first line. Otherwise, channels 14 are located to interconnect each adjacent dimple.

With this design, an "octahedral" array of dimples is achieved. Specifically, eight triangular groups of dimples are formed, and in the embodiment shown, each group contains 45 dimples for a total of 360 dimples on the ball surface.

The dimples 12 preferably have a diameter between 0.060 and 0.180 inches and a maximum depth between 0.007 and 0.013 inches. The channels preferably have a width at the ball surface between 0.010 and 0.080 inches and a depth between 0.003 and 0.010 inches at their lowest point. The channel length may be very short since some dimples may be near touching. Typically, the length will vary between 0.005 and 0.070 inches.

Figure 2:
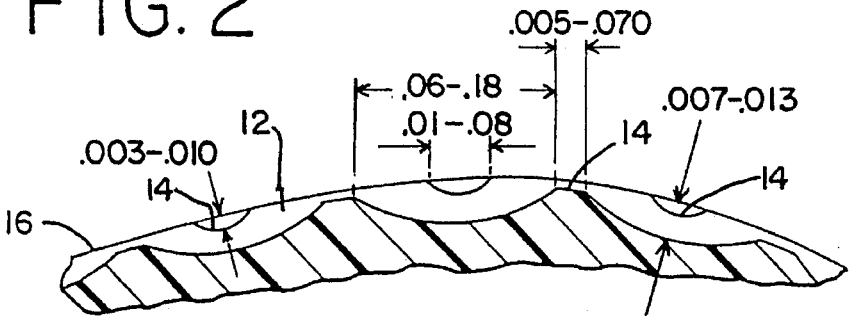

It is also preferred that the dimple depth exceed the channel depth as is illustrated in FIG. 2. With the volume occupied by the 360 dimples and the channels combined, the total effective volume can be maintained above a desired level as described in the aforementioned Pocklington application Ser. No. 08/386,812.

In a typical case, a ball 10 with 360 dimples will utilize dimples 12 of approximately 0.130 inches in diameter with a maximum depth of 0.010 inches. The channels 14 will have a width of 0.045 inches, a maximum depth of 0.0035 inches, and an average length of 0.03 inches.

Although the dimples 12 are illustrated as having the same diameter and depth, it will be understood that variations in size on a given ball are contemplated as described, for example, in Molitor U.S. Pat. No. 5,273,287, FIG. 5. Similarly, variations in channel dimensions on a given ball may be utilized.

Channels 14 are shown connecting all adjacent dimples (except along the lines 18 and 20) whereby from two to five channels may extend from a single dimple. The invention contemplates less than complete interconnection for purposes of "fine tuning" the ball performance. Thus, the height of shots and/or spin characteristics can be varied in this fashion. The one consideration most important in this regard is that the channel locations be substantially symmetrically positioned around the ball surface.

The golf balls of this invention are intended to have improved flight characteristics. Specifically, it is believed that the inclusion of the interconnecting channels lends stability during flight that insures straighter shots over long distances.

It will be understood that various changes and modifications may be made in the above-described invention without departing from the spirit thereof, particularly as set forth in the following claims.

I claim:

1. A golf ball construction comprising a core and cover, said ball defining an equator forming a first great circle extending over the cover surface, at least two additional great circles extending over the cover surface and intersecting said first great circle, said additional great circles being spaced apart equally with respect to each other whereby said ball surface is divided by the combination of the first great circle and the additional great circles into a plurality of discrete symmetrically arranged surface areas, a separate array of spaced-apart dimples formed on the cover surface within each of said discrete surface areas, each of said arrays covering substantially completely the cover surface in each discrete area, and including channels formed exclusively within each discrete area and extending between adjacent ones of the dimples in each area, one of said channels extending from each dimple to every other dimple adjacent thereto, and none of said channels crossing any of said great circles.

2. A golf ball construction according to claim 1 wherein from two to five channels extend from any one dimple.

3. A golf ball construction according to claim 1 wherein each dimple has a diameter between 0.060 and 0.180 inches and a maximum depth of between 0.007 and 0.013 inches, and wherein each channel has a width at the ball surface of between 0.010 and 0.080 inches, a maximum depth of between 0.003 and 0.010 inches, and a length between 0.005 and 0.070 inches.

4. A golf ball construction according to claim 3 wherein the maximum depth of the dimples exceeds the maximum depth of the channels, and wherein the diameter of the dimples exceeds the diameter of the channels.

5. A golf ball construction according to claim 1 wherein said additional great circles consist of two great circles intersecting said first great circle at a 90° angle and extending through the poles of the ball, the said two great circles being positioned at right angles to each other whereby eight discrete surface areas are formed by the great circles.

6. A golf ball construction according to claim 5 wherein a triangular dimple array is formed in each of the eight areas on the ball surface formed between said equator and said circumferential line.

7. A golf ball construction according to claim 6 wherein each array consists of 45 dimples for a total of 360 dimples on the ball.

* * * * *